US005964005A

United States Patent [19]

Williams et al.

[11] Patent Number: 5,964,005

[45] Date of Patent: Oct. 12, 1999

[54] SCRUBBING AND MOPPING APPARATUS

[75] Inventors: Todd A. Williams, Aliso Viejo; Richard A. Williams, Dana Point, both of Calif.; Lisa Marie Goodman, Grayson, Ga.

[73] Assignee: S.C. Johnson Commercial Markets, Sturtevant, Wis.

[21] Appl. No.: 08/964,154

[22] Filed: Nov. 6, 1997

[51] Int. Cl.[6] ..... A47L 13/12

[52] U.S. Cl. ..... 15/115; 15/118

[58] Field of Search ..... 15/114, 115, 116.1, 15/116.2, 118

[56] References Cited

U.S. PATENT DOCUMENTS

| | | | |
|---|---|---|---|
| D. 358,487 | 5/1995 | Kneesch et al. . | |
| 377,955 | 2/1888 | O'Blenus . | |
| 399,223 | 3/1889 | Varney . | |
| 702,998 | 6/1902 | Randolph . | |
| 729,581 | 6/1903 | Held . | |
| 732,743 | 7/1903 | Held . | |
| 798,532 | 8/1905 | Sanders . | |
| 937,007 | 10/1909 | McLaughlin . | |
| 981,756 | 1/1911 | Glancey . | |
| 1,067,570 | 7/1913 | Ziegler . | |
| 1,171,768 | 2/1916 | Browning . | |
| 1,221,606 | 4/1917 | Sadler . | |
| 1,331,477 | 2/1920 | Albin . | |
| 1,589,253 | 6/1926 | Smiechewicz . | |
| 1,748,202 | 2/1930 | Bloomfield . | |
| 2,133,148 | 10/1938 | Paul . | |
| 2,196,365 | 4/1940 | Schulman | 15/115 |
| 2,518,765 | 8/1950 | Ecker . | |
| 2,641,787 | 6/1953 | Vosbikian et al. . | |
| 2,678,458 | 5/1954 | Vosbikian et al. . | |
| 2,683,886 | 7/1954 | Neumann . | |
| 2,701,888 | 2/1955 | Vosbikian et al. . | |
| 3,157,901 | 11/1964 | Murphy . | |
| 3,167,798 | 2/1965 | Dryden . | |
| 3,906,580 | 9/1975 | Smith et al. . | |
| 3,964,121 | 6/1976 | Kim . | |
| 4,802,782 | 2/1989 | Scalf . | |
| 5,435,852 | 7/1995 | Robinson . | |
| 5,522,110 | 6/1996 | Borofsky . | |
| 5,584,091 | 12/1996 | Borofsky . | |

FOREIGN PATENT DOCUMENTS

| | | |
|---|---|---|
| 737140 | 6/1966 | Canada . |
| 1309326 | 10/1962 | France . |

*Primary Examiner*—Terrence R. Till
*Attorney, Agent, or Firm*—William W. Haefliger

[57] ABSTRACT

An apparatus for scrubbing and mopping a surface, comprising in combination, a supporting carrier, including a block and scrubbing media carried by the carrier, to project toward the surface for scrubbing that surface; first structure for attaching an elongated handle to the carrier to extend in a first direction from the carrier; and second manually manipulable structure for attaching a mop to the carrier, with mop strands extending in generally parallel relation with that surface and in mopping contact therewith, as the scrubbing media simultaneously engages that surface, for simultaneous mopping and scrubbing of that surface, as the handle extends at an angle to the surface to displace the carrier, bristles and mop parallel to the surface.

31 Claims, 12 Drawing Sheets

19
26
24a
67a
28
23
85
24
25
81a
13
81b
81
71
67
84
70
27
80a
67
80b
80
65a
69
13b
21
65

31
13
13b
35
90
65

13
13a
35
91
92

111
106
104
110
103
13b'
101
13
102
105
100
96
97

112
140
127
111
117
125
113
126
116
110

112
131
130
19
18
18
19
127
123
121
120
117
117a
113
125
116a
116
118
119
122
126

SCRUBBING AND MOPPING APPARATUS

BACKGROUND OF THE INVENTION

This invention relates generally to treatment such as cleaning of surfaces, and more particularly, to improvements in apparatus for scrubbing and mopping of surfaces by force application, as via an elongated handle.

Many surfaces to be cleaned contain interstices, cracks or crevices, in which dirt particles become embedded, or otherwise build up. Examples are cracks between tiles forming tiled surfaces, cracks and crevices in marble, clay, concrete, or synthetic material flooring, and surface interstices in many different types of floors. It is extremely efficient to remove such embedded or built up dirt particles using conventional mopping apparatus and/or procedure. It becomes necessary to scrub such surfaces, using a brush or brushes having bristles that can reach and remove the embedded soil or dirt particles.

In the past, it was known to provide for scrubbing and mopping of floor surfaces, using elongated handled equipment; however, such equipment lacked the unusually advantageous improvements in structure, functions and results, as are now enabled and produced by the present invention, and meeting needs for improved and

SUMMARY OF THE INVENTION

It is a major object of the invention to provide improved method and apparatus meeting the above needs. Basically, the apparatus of the invention includes the following:

a) a supporting carrier, including a block and scrubbing means carried by the carrier, to project toward a surface to be cleaned, for scrubbing that surface, b) first means for attaching an elongated handle to the carrier to extend in a first direction from the carrier, c) and structure, for attaching a mop to the carrier to extend in generally parallel relation with that surface and in mopping contact therewith as the scrubbing means simultaneously engages that surface, for mopping and scrubbing the surface simultaneously as the handle extends at an angle to the surface to displace the carrier, scrubbing means and mop parallel to the surface.

It is another object of the invention to provide such a device wherein the mop has a head attached to the carrier proximate a first side of the carrier, which extends laterally to provide support and stability for both the mop and the scrubbing means.

It is another object to provide a device, as referred to, wherein the handle is attached to the carrier at a second location, typically spaced from the location of mop head attachment to the carrier.

It is another object to provide a carrier having first and second parts which are relatively movable longitudinally, the scrubbing means carried by at least one of the parts, the parts relatively adjustably movable longitudinally to clamp the mop head.

A further object is to provide manually manipulable structure in the form of a bail carried by the carrier to adjustably swing into mop head clamping position. Such structure may also include a bar adjustably movable relative to the bail to clamp the mop head between the bar and bail, there being an adjustable connection between the bar and carrier to adjustably move the bar relative to the bail.

Yet another object is to provide manually manipulable structure that includes an adjustable clamp for adjustably clamping the mop head and having a first position in which the mop head is removable from attachment to the carrier, and a second position in which the mop head is attached to the carrier. In this regard, the clamp may have a part with adjustable screw thread fastener attachment to the carrier. Such attachment may advantageously include a rotor presented at a side of the carrier for manual manipulation to adjust the screw thread attachment.

A still further object includes provision of a lever having an over-center pivoted position in which the mop head is clamped.

Yet another object is to provide for adjustable attachment of a carrier second part to a first part, at laterally spaced locations. Fasteners may be provided at such locations, both fasteners adjustable to allow relative longitudinal movement of the two parts for mop installation and removal.

Alternatively, the first and second parts may have pivoted attachment at one of such locations, whereby the second part is swingable toward and away from the first part. The two parts may then have longitudinally adjustable attachment at the other of such locations, that attachment being advantageously in the form of a ratchet connection between the parts.

An additional object includes provision of rows of bristles, the bristles of at least one row having length greater than bristles in other rows, the one row extending parallel to the mop head.

The apparatus of the present invention can be used for cleaning floors with tough dirt, stuck litter and oil stains. The cleaning apparatus is especially suitable for cleaning industrial floors, such as the floors of restaurants' kitchens, which usually are made of clay or concrete, with rough and porous surfaces to protect slipping. Advantageously, the cleaning apparatus of the present invention can perform surface cleaning and scrubbing and/or brushing functions simultaneously and conveniently by providing a mop and scrubbing block being removably and adjustably installed in a single assembly.

These and other objects and advantages of the invention, as well as the details of an illustrative embodiment, will be more fully understood from the following specification and drawings, in which:

DRAWING DESCRIPTION

FIG. 4 is an enlarged section taken on lines 4—4 of FIG. 2;

DETAILED DESCRIPTION

Figure 1:
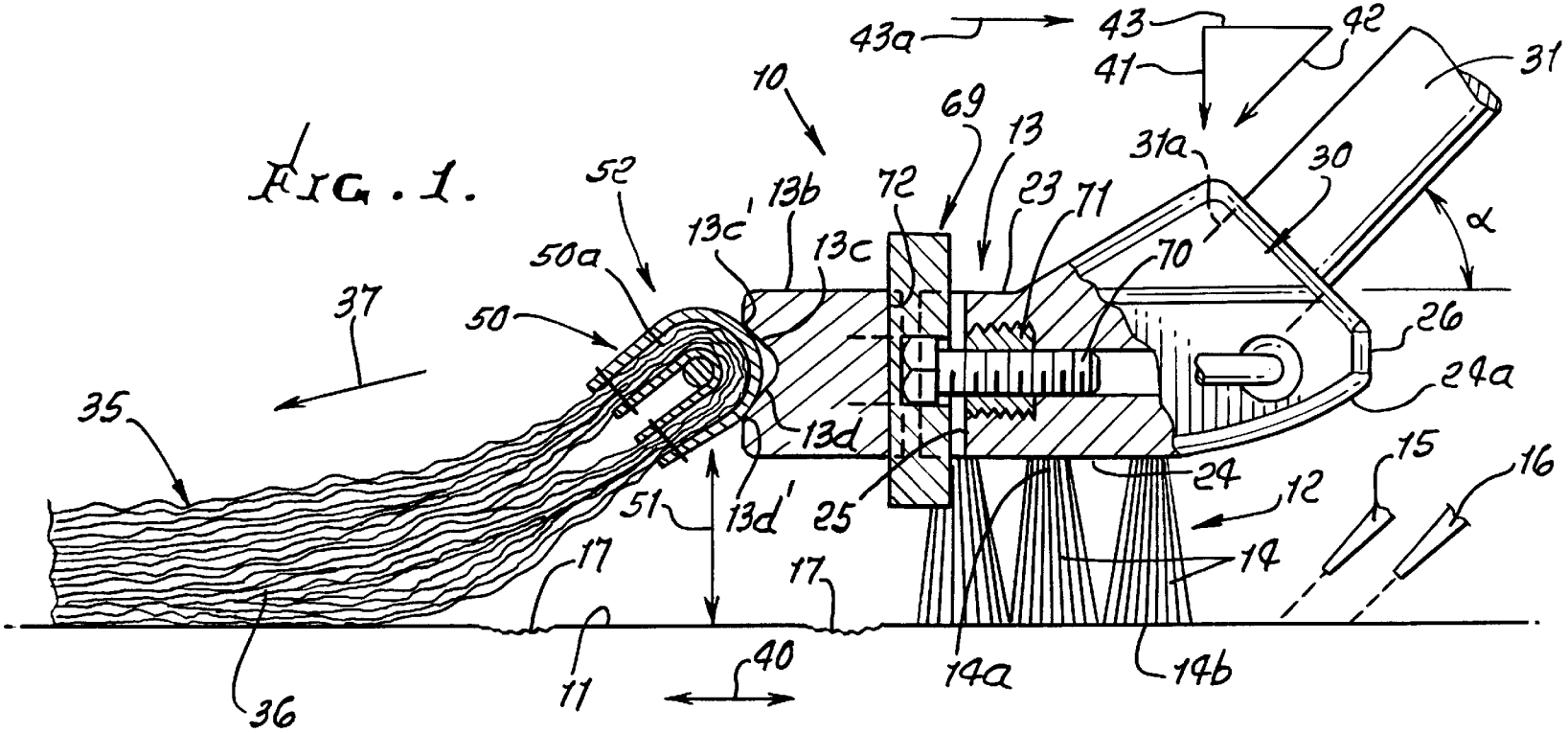
FIG. 1 is a side elevation, in section, of apparatus embodying the invention.

In FIG. 1, a preferred form of the apparatus 10, for scrubbing and mopping a surface 11, such as a floor, is shown in operating position. The basic elements comprise a scrub brush 12 that includes a carrier 13, and bristles 14 having their upper ends 14*a* carried by the carrier at its underside. The bristles project, as for example, downwardly as shown, toward the surface 11 in position for contacting that surface at bristle lower ends 14*b*.

Water and/or chemical cleaner may be applied to that surface, as at 15 and 16, to aid in bristle dislodgment of soils, grit and dirt particles from interstices and cracks in that surface. These are indicated at 17, and may take various forms.

Figure 2:
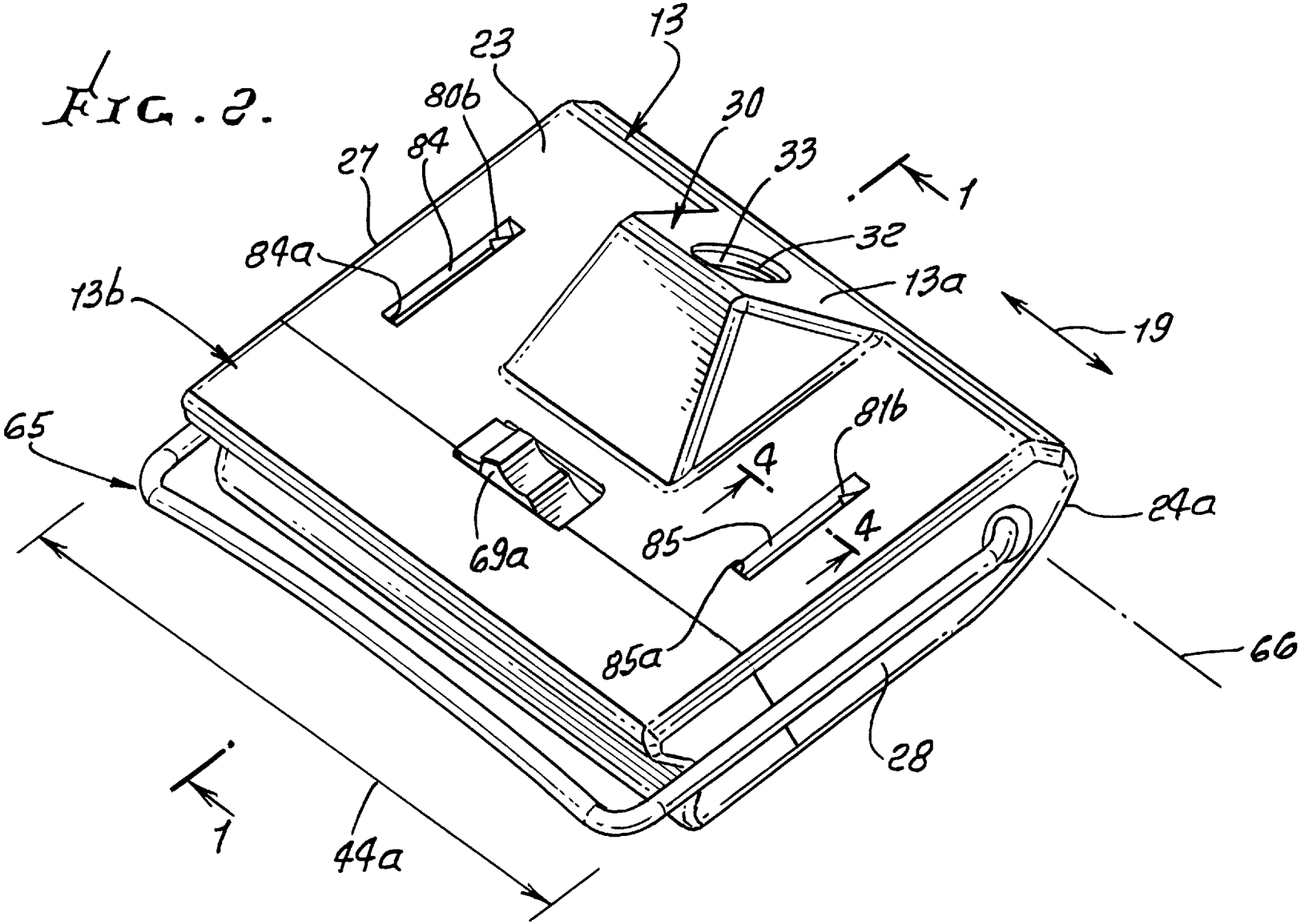
FIG. 2 is a three dimensional view of the FIG. 1 apparatus, without the mop attached.
Figure 3:
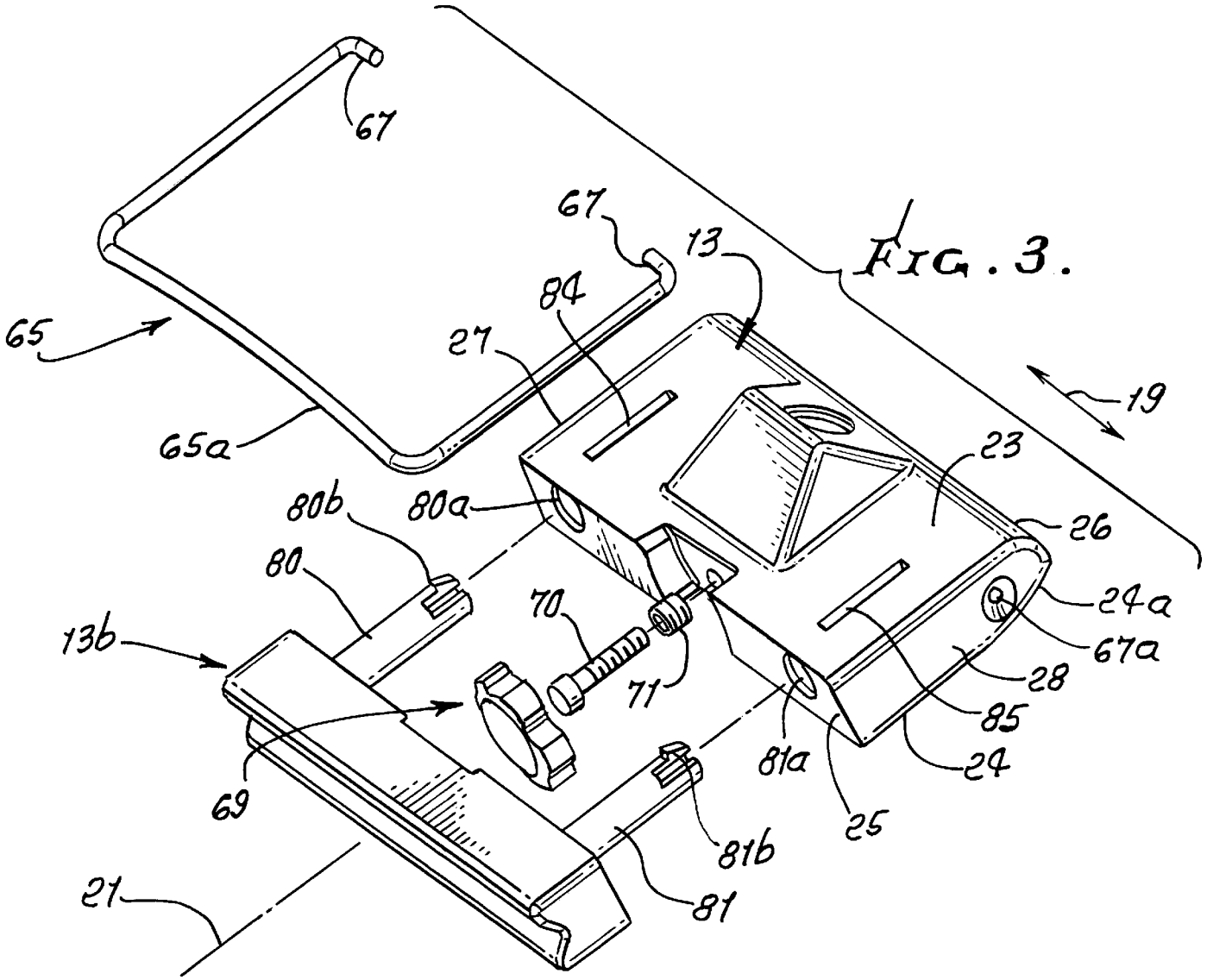
FIG. 3 is an exploded view like that of FIG. 2.

Carrier 13 is typically laterally elongated in directions 19, as seen in FIG. 2, and relative to a longitudinal axis 21, seen in FIG. 3. Carrier 13 may consist of wood, plastic, or other material, and has an upper side 23, a bottom side 24 from which the bristles project, a front side 25, a rear side 26, and opposite ends 27 and 28. Side 25 may be perpendicular, or substantially perpendicular, to axis 21, and to the planes of upper and lower sides 23 and 24. Surface 24 may be beveled as at 24*a*, to facilitate rocking of the carrier, as during use.

First means is provided, as at 30, for attaching an elongated handle 31 to the carrier, to extend in a first direction from the carrier, which may have block shape. Such first means may, for example, include female screw threading at 32 formed in a recess 33 sunk downwardly and forwardly in a protrusion 13*a* at the carrier top side 23, mid-way between opposite ends 27 and 28. The lower end portion 31*a* of the handle may form or carry complementary male threading to rotatably attach to threading 32, whereby the handle is firmly connected to the carrier, to extend upwardly and rearwardly at an angle a relative to and above axis 21.

Another basic element of the apparatus comprises a mop seen at 35 and having flaccid strands 36 shown in FIG. 1, as extending forwardly of the front side 25 of the carrier in direction 37. Second means is provided for attaching the mop to the carrier, whereby the strands 36 extend in generally parallel relation with surface 11, the lower strands freely engaging that surface, for mopping same when the carrier 13 is moved frontwardly and rearwardly in directions 40, as seen in FIG. 1, and simultaneously with bristle scrubbing engagement with the surface.

Accordingly, the downward component 41 of handle force 42 exerted on carrier 13 acts to push the bristles downwardly into and over the crevices, cracks and interstices 17 at the same time as the forward component 43 of handle force pushes or displaces the flaccid mop strands 36 forwardly, and subsequently the rearward component 43*a* of handle force pulls the strands 36 rearwardly over the interstices and cracks 17, to displace liquid into and from the crevices and cracks 17, carrying away or removing the bristle loosened soils and dirt. Fresh, aqueous liquid and/or cleaner is simultaneously mopped into the crevices or cracks to aid in loosening remanent soils and dirt, as the bristles are subsequently displaced forwardly again, with downward force component applicable at 41 to further or complete the soils and dirt loosening in the cracks and crevices filled with mopped liquid. The downwardly yieldable resilient spring aspect of the relatively stiff bristles assists in their penetration of the cracks and crevices under the influence of the downward force component 41.

The mop 35 has flaccid strand lateral dimension approximating the lateral dimension 44*a* of the brush carrier, and bristles, whereby the simultaneous mopping and scrubbing effect, as described, is attained throughout the approximately equal lateral extents of the carrier and mop.

Further, preferred attachment of the mop head 50 proximate the front side 25 of the carrier 13, above the level of the floor (see dimension 51 in FIG. 1) attains maximum proximity of the main extent of the mop to the floor 11, to enhance mopping and scrubbing effect, as described, while also facilitating direct, forward and rearward force transmission from the carrier to the mop head 50 and to the mop 35, for ease of required force transmission (push and pull) to the handle from the user's arm.

The mop head 50 consists of a tightly gathered bundle of mop strand portions, which may be clamped together, as at 50*a*. The tight bundle also provides a semi-rigid support and holder for attachment of the mop head to the front side 25 of the carrier 13, with the laterally elongated head 50 in parallel relation to the laterally elongated carrier front side or side wall 25. A mutually supporting relation of the head and carrier is thereby achieved.

Manually adjustable structure is provided for adjustably attaching the mop head to the carrier 13. In the preferred embodiment of FIGS. 1–3, a second carrier part 13*b* is provided to be movable relative to the above-described carrier 13 (or first carrier part); and second part 13*b* is adjustably movable longitudinally to clamp the mop head. In FIG. 1, the part 13*b* is adjustably movable leftwardly, i.e., forwardly, relative to carrier 13, to cause the V-shaped surfaces 13*c* and 13*d* to clamp and center the mop head at engagement location 13*c*' and 13*d*'.

The adjustable structure also includes a bail 65 carried by carrier 13 to adjustably swing about an axis 66, into mop head clamping position, i.e., the position seen in FIG. 1. The bail has pivotal attachment, as at 67, to side openings 67*a* in walls 27 and 28 of the carrier 13, whereby bail cross bar 65*a* can be swung upwardly, allowing the mop head to be fitted over the bar 65*a*, and subsequently swung downwardly to FIG. 1 position. Thereafter, the carrier part 13*b* in the form of a bar is displaced leftwardly to FIG. 1 position, to clamp the mop head between cross bar 65*a* and the V-shaped surfaces 13*c* and 13*d*. Three-point support of the mop head is thereby achieved, locating it against slippage up or down, or otherwise, from the position shown. Carrier part 13*b* acts as a clamp, for the mop head.

Rotation of an adjustable rotor 69 shifts the carrier part 13*b* to the left and to the right, as needed, the rotor surface 69*a* protruding above the top surfaces of 13*b* and of 13, to allow easy adjustment. The rotor may carry a shaft 70 that projects longitudinally into carrier 13, to have threaded engagement with a nut 71 attached to 13, whereby as the rotor is rotated, it moves longitudinally with 13*b*. The rotor may have suitable attachment to 13*b*, as at 72, allowing rotor rotation, and also travel with 13*b*.

FIGS. 3 and 4 show guide pins 80 and 81 carried by part 13*b*, and projecting longitudinally rearwardly for reception in guide bores 80*a* and 81*a* in carrier block 13, to guide longitudinal movement of 13*b* relative to 13. Upward projections 80*b* and 81*b* on the pins are received in slots 84 and 85 in the carrier block, and are engageable with slot terminal shoulders 84*a* and 85*a* to prevent removal of 13*b* from 13.

Figure 5:
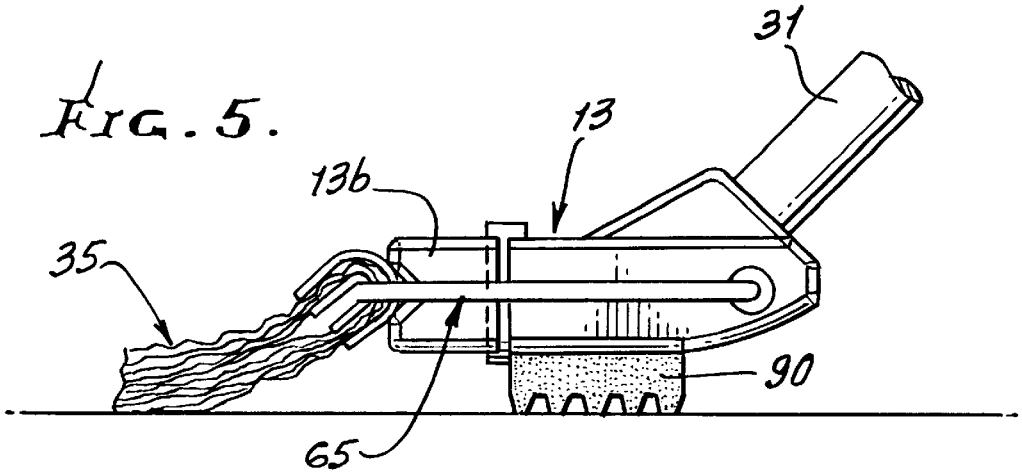
FIGS. 5–7 are elevations like FIG. 1 but showing modifications.

FIG. 5 is like FIG. 1 excepting that a scrubbing pad 90 is substituted for the bristles.

Figure 6:
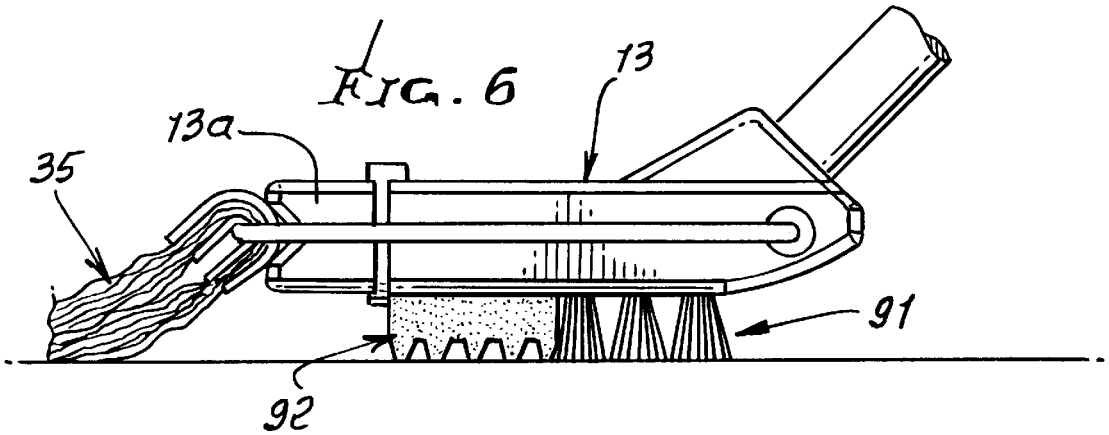

FIG. 6 shows both bristles 91 and a scrubbing pad 92, substituted for the bristles of FIG. 1.

Figure 7:
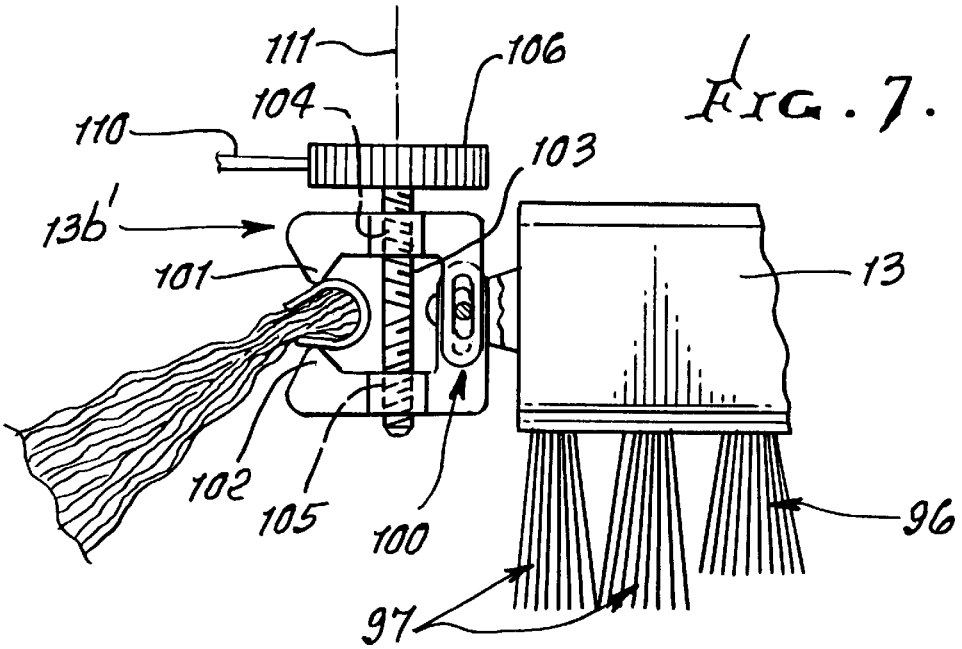

FIG. 7 shows bristles 96 in one lateral row of relatively shorter length; and bristles 97 in other lateral rows of relatively longer length. FIG. 7 also shows a modified carrier second part 13*b*' attached at 100 to carrier part 13. Carrier second part 13*b*' is C-shaped to form clamp jaws 101 and 102, for clamping the mop head. A threaded shaft 103 engages threading at 104 and 105 in the clamp to move the jaws toward or away from one another, as a rotor 105 is rotated in one direction or the other.

Threading 104 is in reverse sense relative to threading 105. A lever arm 110 may project from the shaft or from the rotor, to provide greater clamping force, as the lever is rotated about axis 111. An over-center detent may be provided.

Note that in FIGS. 1–7, attachment of the mop head to the carrier is provided at a second location 52 (see FIG. 4) forwardly spaced from the first means of attachment of the handle to the carrier block. This assures that the downward component of force 41 will be substantially completely transmitted to the scrubbing means, and not to the mop itself, for maximum scrubbing effect. Spacing 51 assures this. Note in this regard that the second location 52 attachment and the attachment at 30 define an upright and forward plane that bisects the carrier body or block. That plane bisects the scrubbing means, the mop head 50 and the mop 35 for optimum stability during use.

Figure 8:
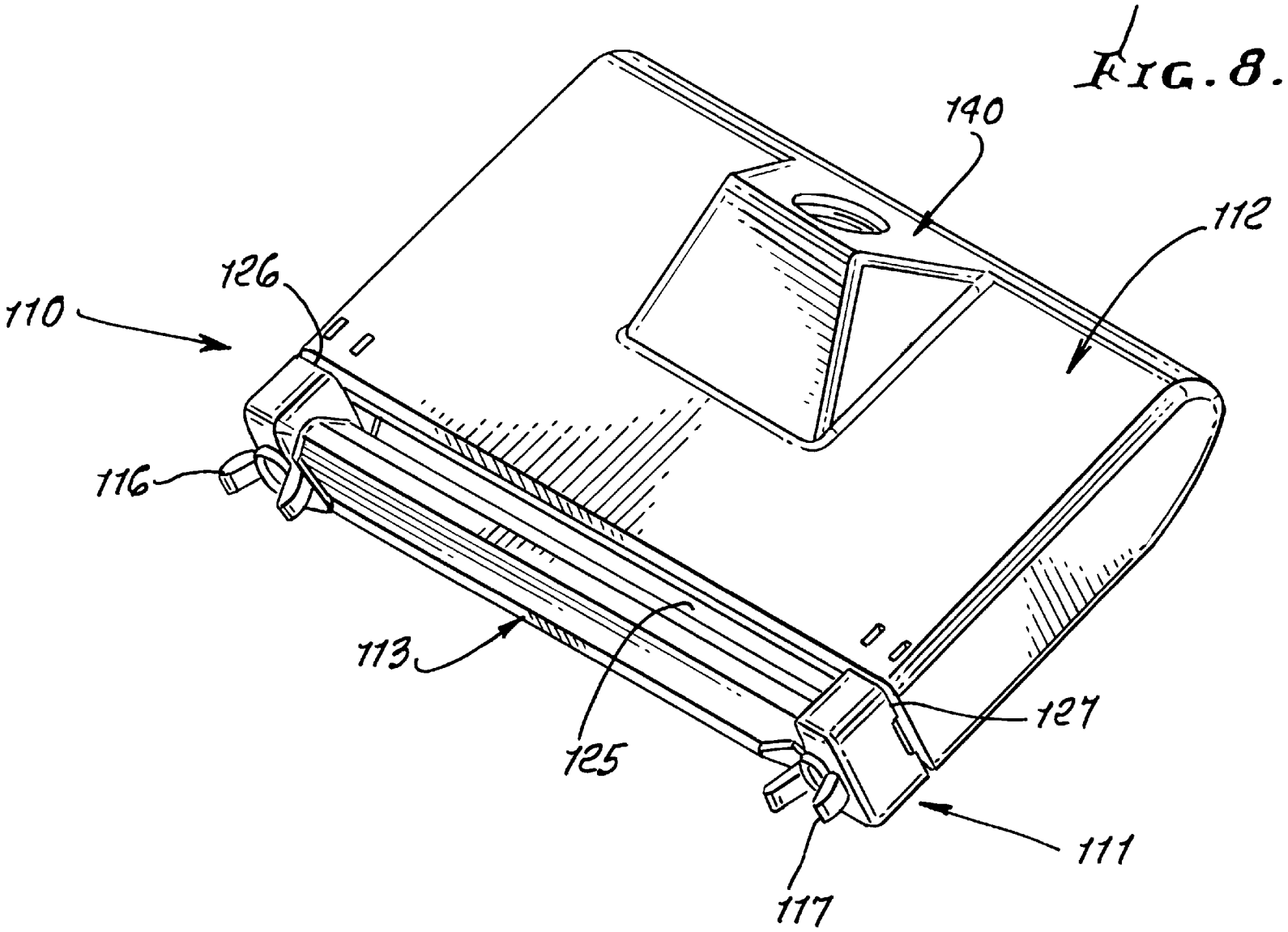
FIG. 8 is a view like FIG. 2 but showing a modification.
Figure 9:
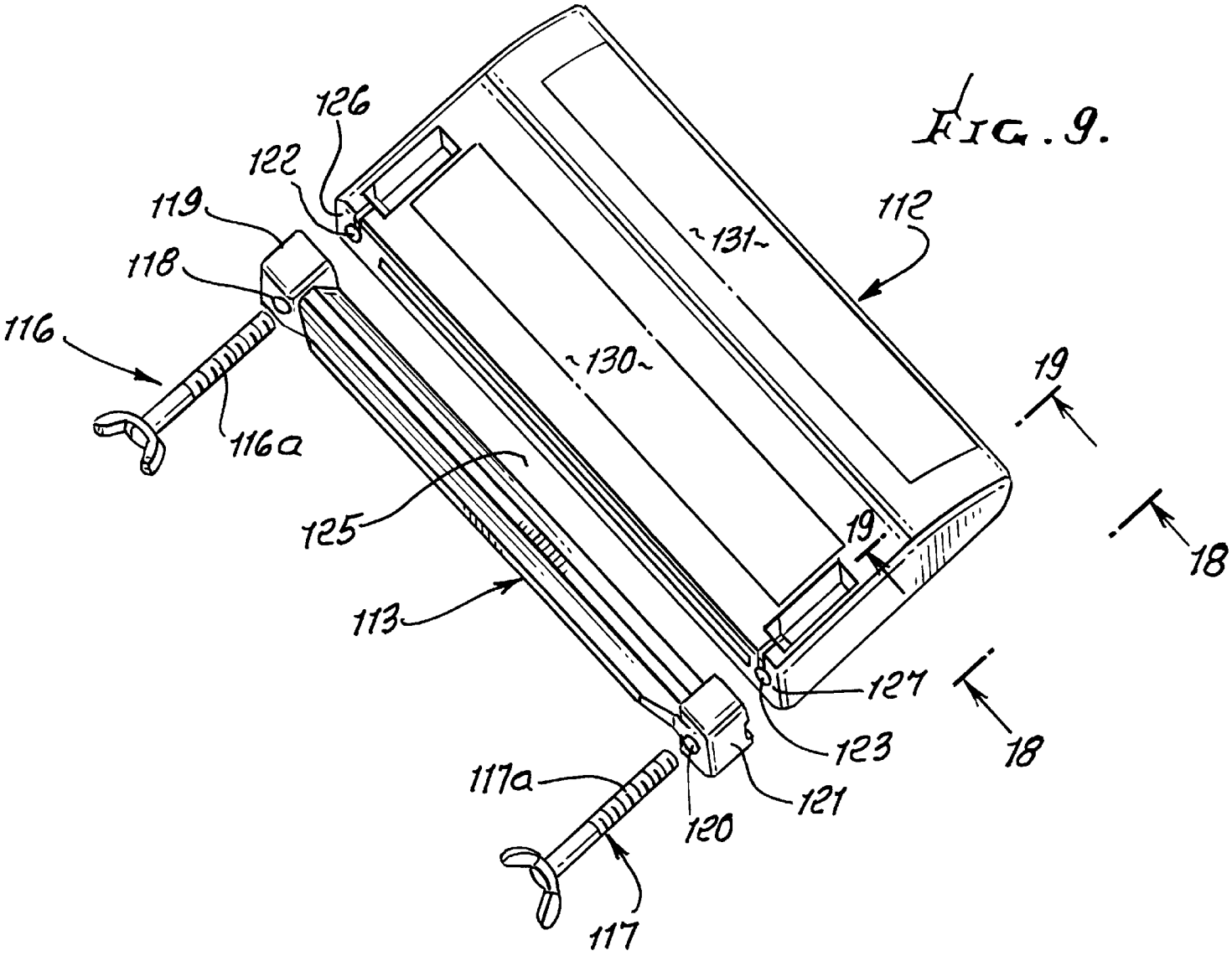
Figure 10:
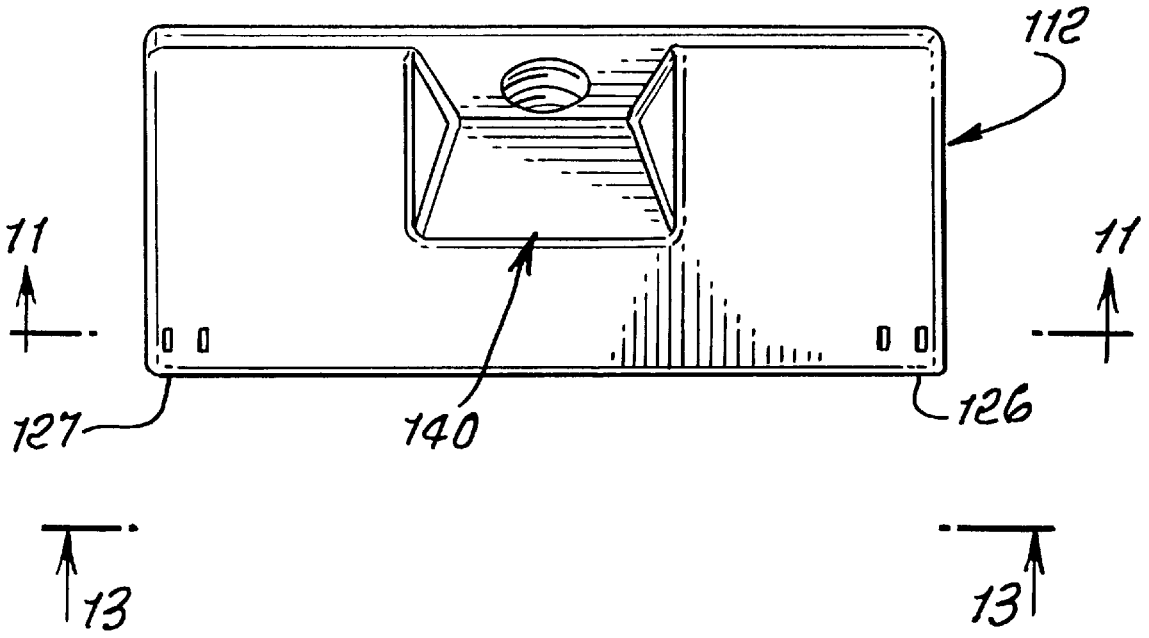
FIG. 10 is a plan view of a first of the parts seen in FIG. 8 and having a top protrusion.
Figure 11:
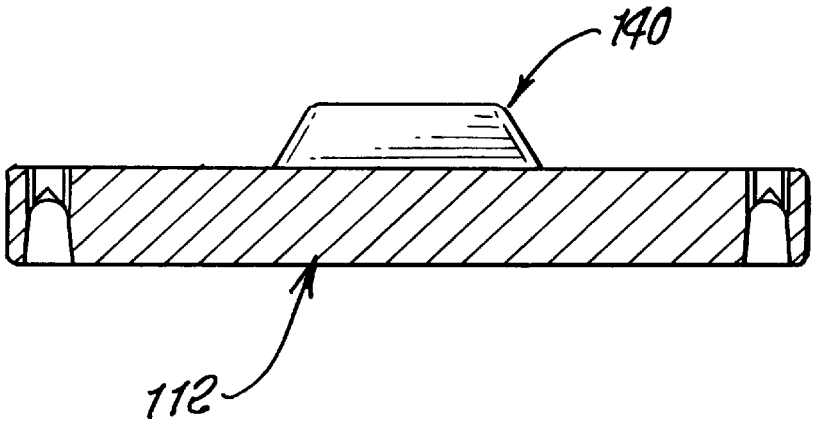
FIG. 11 is a section taken on lines 11—11 of FIG. 10.

In the embodiment shown in FIGS. 8–19, the carrier second part, which is relatively movable longitudinally, with respect to the carrier first part, has attachment to that first part at substantially laterally spaced locations, generally indicated at 110 and 111 in FIG. 8. The first part is generally indicated at 112, and the second part is generally indicated at 113. Part 112 corresponds to carrier 13; and the carrier second part 113 corresponds generally to carrier part 13*b* in FIG. 2, in that it is movable longitudinally relative to part 112. Part 113, in the form of a bar extending between locations 110 and 111, also incorporates the functions of the bar 65 seen in FIG. 2, in that it attaches the mop to the carrier structure.

Figure 9:
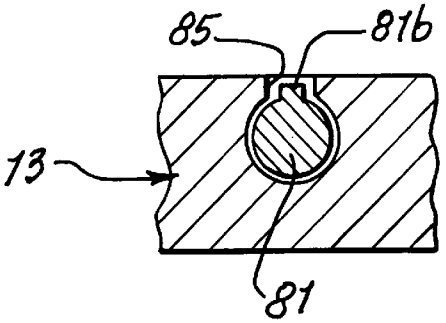
FIG. 9 is an exploded view, like FIG. 3, of the FIG. 8 modification.

Two fasteners, such as those indicated at 116 and 117, are provided at the laterally spaced locations, such fasteners being adjustable to allow relative longitudinal movement of the parts 112 and 113. For example, as seen in FIG. 9, fastener 116 has a shank 116*a* that extends through an opening 118 in a lug 119 on bar part 113; and likewise, fastener 117 has a shank 117*a* that extends through an opening 120 in a lug 121 on the other end of the bar part 113. There are corresponding openings at 122 and 123 in the carrier part 112, to receive the fastener shanks, which may be threaded for tightening purposes. Tightening of the two fasteners adjustably clamps the mop head in the laterally elongated space 125, between 112 and 113; and lugs 119 and 121 may seat against the front surface of the part 112 at locations 126 and 127 for positioning purposes. Loosening of the fasteners allows quick and easy removal of the mop.

Figure 12:
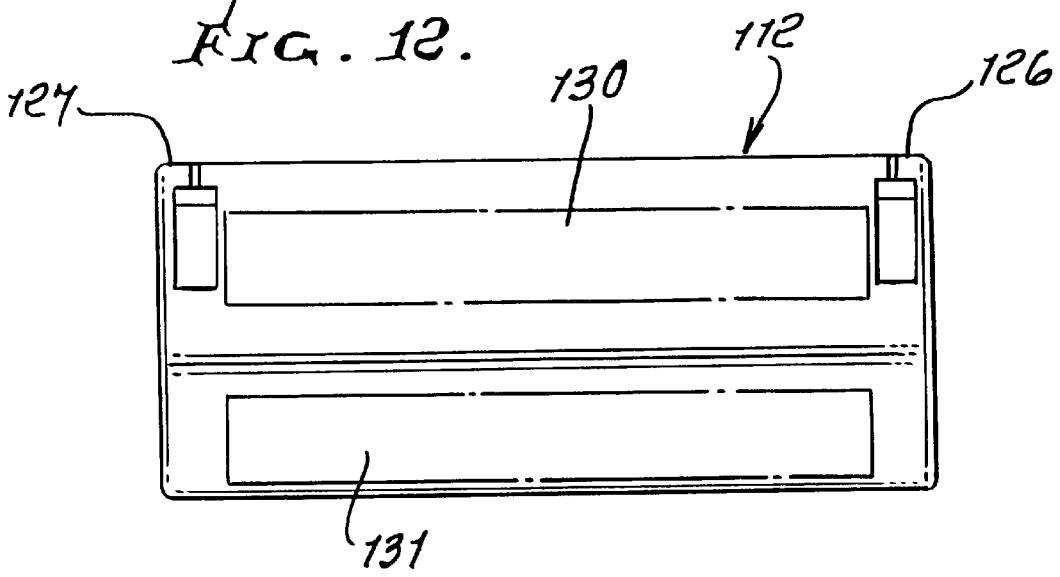
FIG. 12 is a bottom plan view of a FIG. 10 part.
Figure 13:
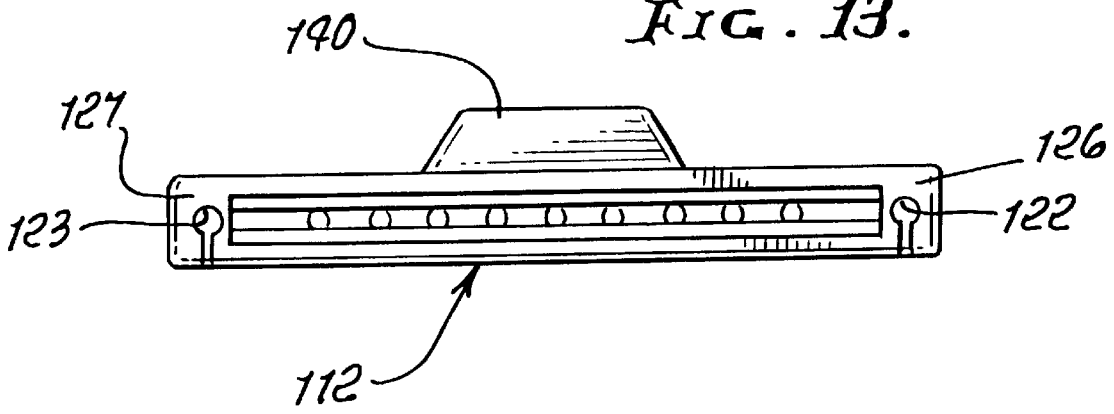
FIG. 13 is a front view taken on lines 13—13 of FIG. 10.
Figure 14:
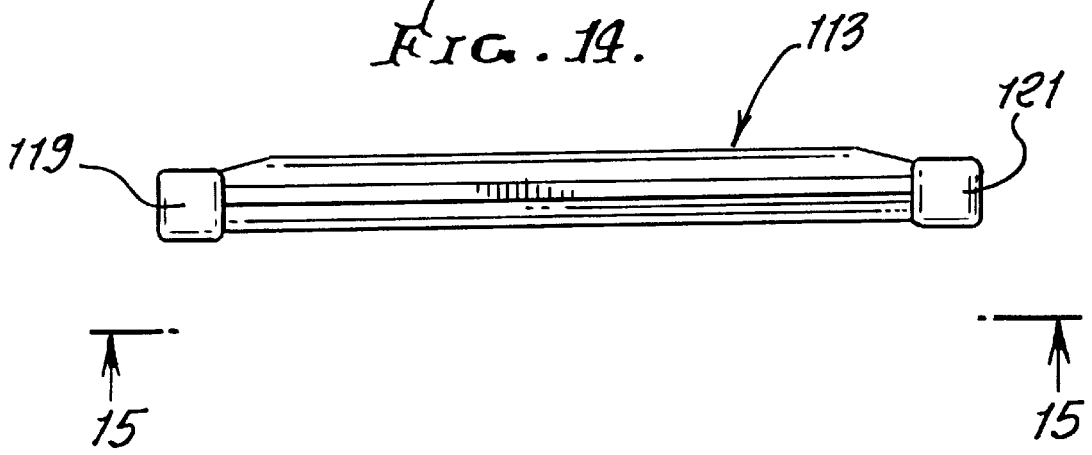
FIG. 14 is a top plan view of the other of the carrier parts seen in FIG. 9.
Figure 15:
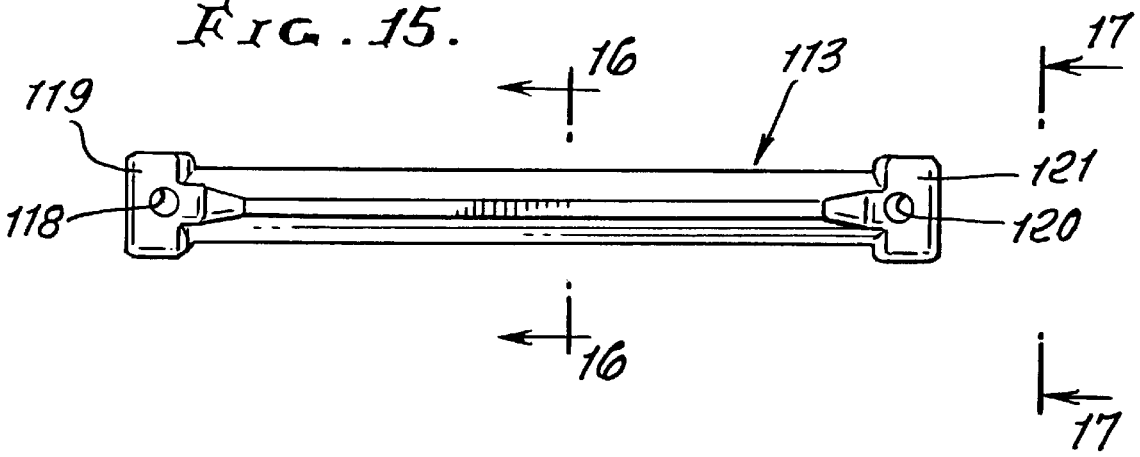
FIG. 15 is a front view taken on lines 15—15 of FIG. 14.
Figure 16:
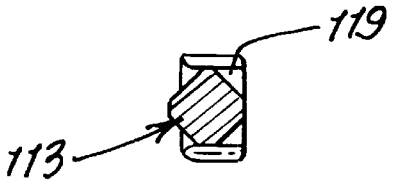
FIG. 16 is an end view taken on lines 16—16 of FIG. 15.
Figure 17:
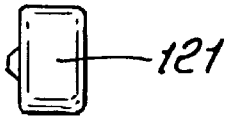
FIG. 17 is an end view taken on lines 17—17 of FIG. 15.
Figure 18:
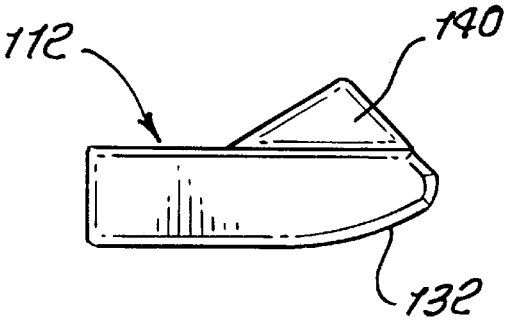
FIG. 18 is a fragmentary elevation taken on lines 18—18 of FIG. 9.
Figure 19:
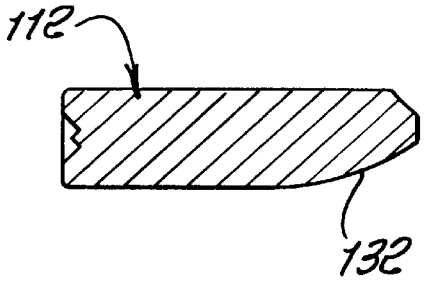
FIG. 19 is a section taken on lines 19—19 of FIG. 9.
Figure 20:
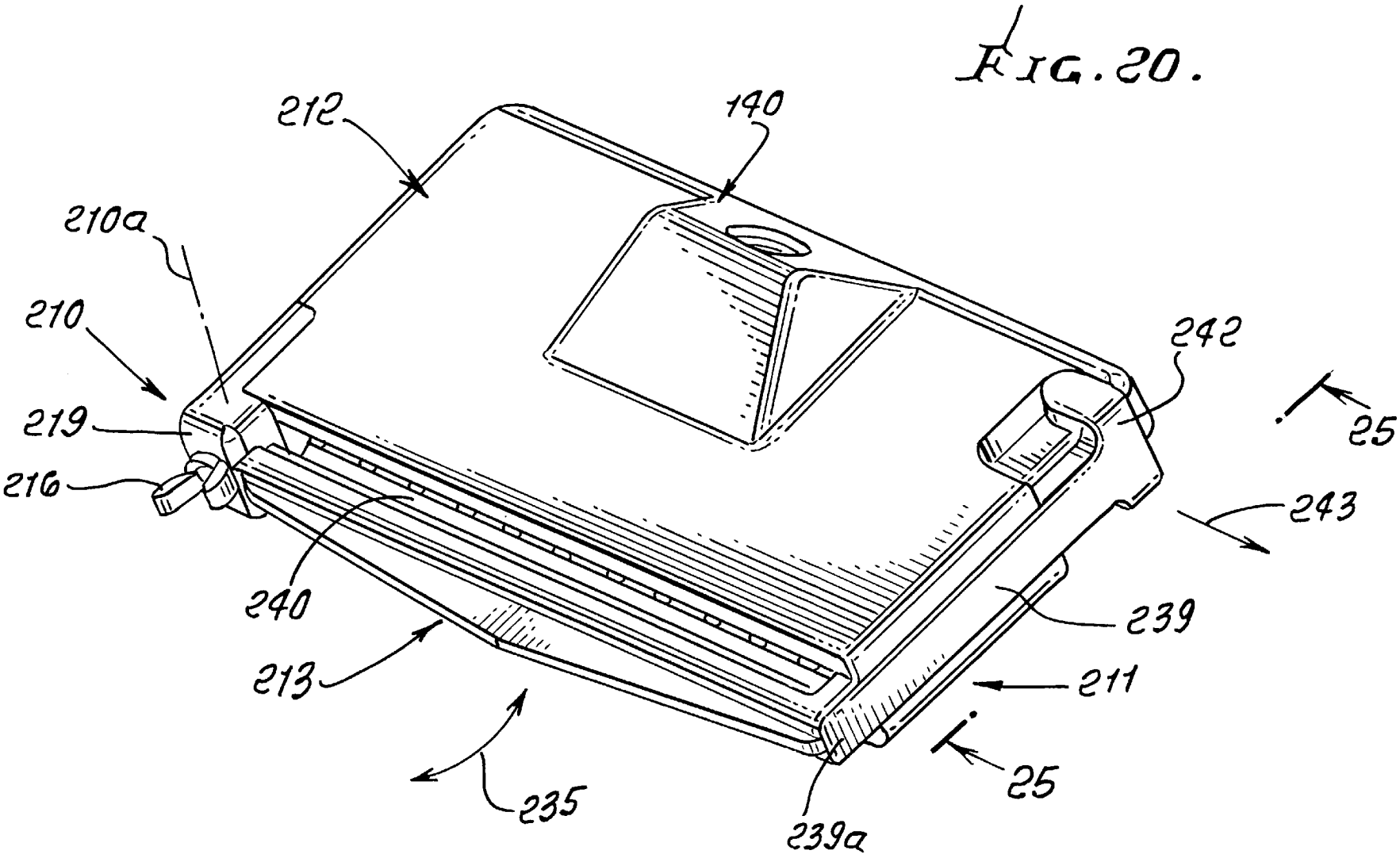
FIG. 20 is a view like FIG. 2 showing a further modification.
Figure 21:
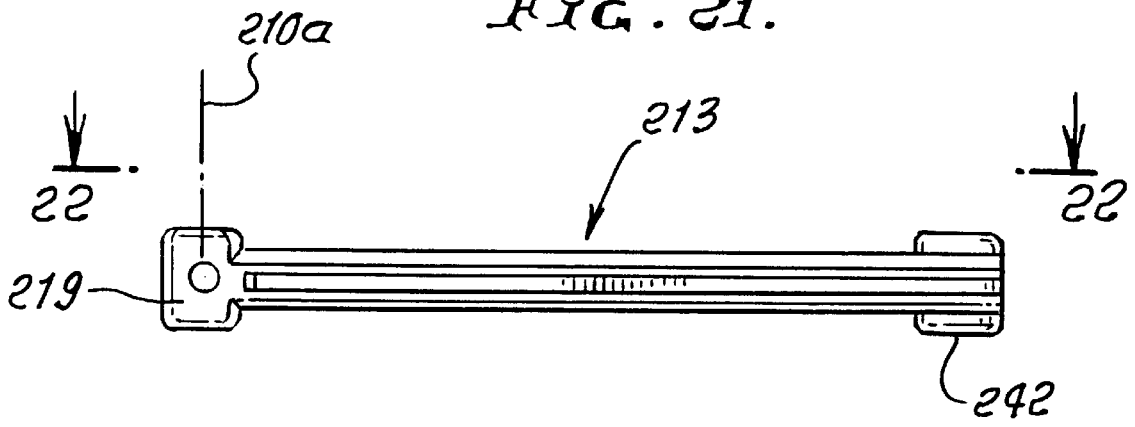
FIG. 21 is a front elevation showing a swingable second part of the apparatus seen in FIG. 20.
Figure 22:
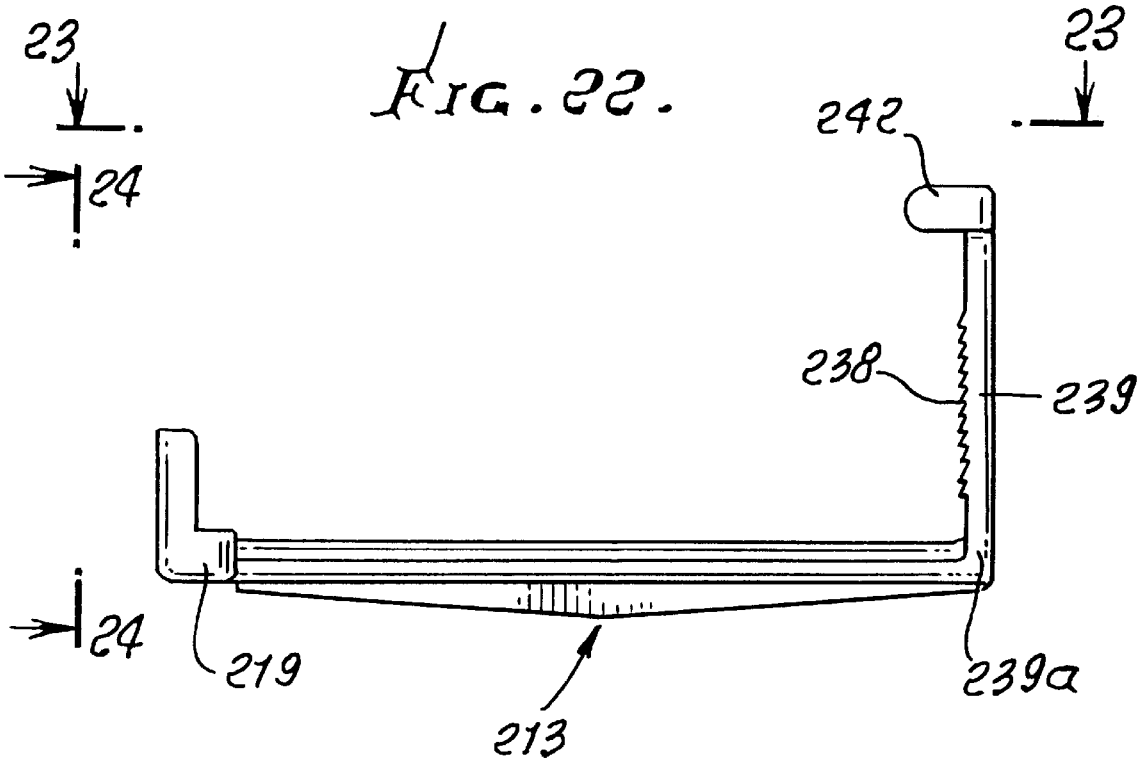
FIG. 22 is a plan view taken on lines 22—22 of FIG. 21.
Figure 23:
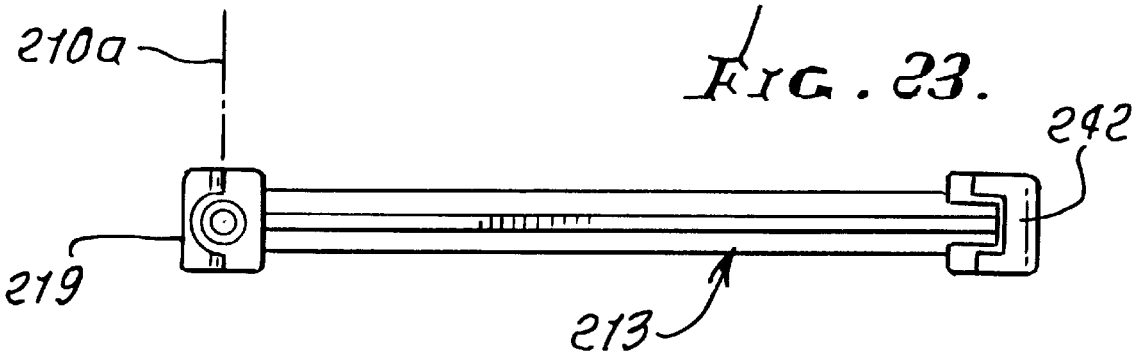
FIG. 23 is an elevation taken on lines 23—23 of FIG. 22.
Figure 24:
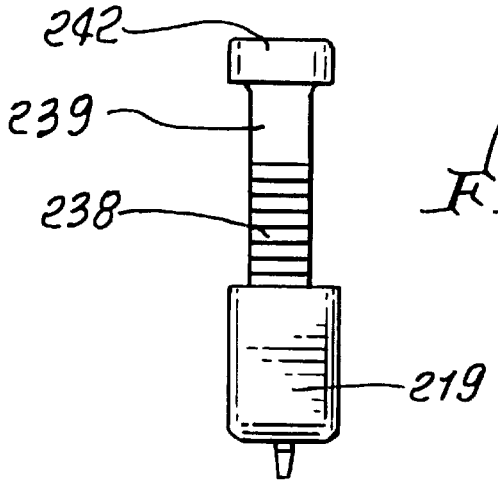
FIG. 24 is an end elevation taken on lines 24—24 of FIG. 22.

Referring to FIGS. 9 and 12 showing the bottom side of the carrier 112, bristles may be located at areas or zones 130 and 131 to extend downwardly for engagement with the floor. Note also in FIGS. 18 and 19 the coving of the underside of the carrier 112, at location 132. This allows upright positioning of the carrier, during use, against a wall, so that the bristles at 131 can extend to the intersection of the floor and the wall for scrubbing at that location, very close to the wall. Similar coving is shown at 24*a* in FIG. 2. Upright protrusion 140 on 112 corresponds to 13*a* in FIG. 2.

Reference is now made to the modification in FIGS. 20–26. As shown, the first carrier part 212 is generally like that seen at 13 and also at 112, and carries bristles and/or a scrubbing pad at its underside.

The second carrier part 213 is attached to the first part at substantially laterally spaced locations 210 and 211. Laterally elongated, bar-shaped part 213 has pivoted attachment at one of such locations, as for example location 210, whereby the second part 213 is swingable frontwardly toward and away from the first part, for example as indicated by the arrows 235 in FIG. 20. A vertical pivot axis is provided at 210*a*, seen in FIG. 20, and also in FIGS. 21 and 23. A lug 219 on the bar part 213 has rotary attachment to structure on the carrier part 212 to allow such pivoting. A fastener 216 may also be provided at that location, to adjustably connect the lug to the carrier part 212.

The first and second parts 212 and 213 are shown to have longitudinally adjustable attachment to one another at the second of such locations, generally indicated at 211. Such longitudinally adjustable attachment is shown to be provided in this form of the invention, as by a ratchet connection between such parts.

Figure 25:
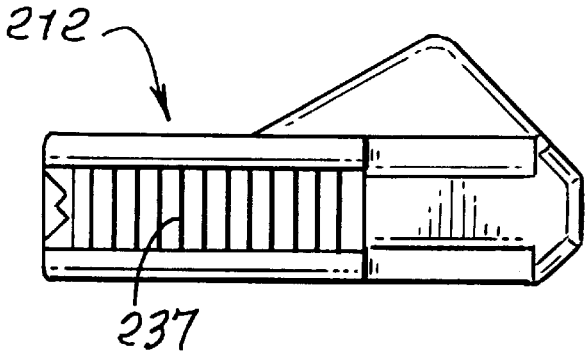
FIG. 25 is an enlarged fragmentary end view taken on lines 25—25 of FIG. 20.
Figure 26:
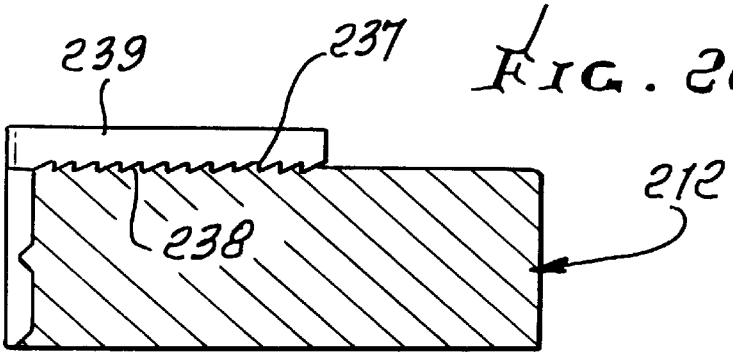
FIG. 26 is a section showing ratcheted interconnection of the first and second parts in FIG. 20 condition.

The ratchet teeth on the carrier part 212 are shown at 237 in FIG. 25, whereby they are at the laterally located end wall of the carrier. The ratchet teeth 238, associated with the bar part 213, are provided on an arm 239, which extends longitudinally, and has one end 239*a* integral with the right end of the bar 213. See also FIGS. 22 and 24. When the arm 213 is pivoted toward the carrier part 212, the ratchet teeth 237 and 238 come into adjustable interconnection, as seen in FIG. 26, to hold the part 213 adjustably frontwardly attached to the part 212, with a space 240 therebetween that receives the mop head, in the manner described in FIGS. 8 and 9.

In this regard, arm 239 may be adjustably positioned, longitudinally, to engage the ratchet teeth at relative positions to firmly retain the mop head in position. To release this interconnection, a lug 242 at the opposite end of the arm may be pulled in direction 243 in FIG. 20, disengaging the ratchet teeth and allowing part 213 to be swung away from part 212. The mop, including its head, may then be withdrawn from positioning between parts 212 and 213. The ratchet connection enables adjustable tightening or loosening of the mop head retained to the carrier structure.

We claim:

1. Apparatus for scrubbing and mopping a surface, comprising in combination:

a) a supporting carrier, including a block and scrubbing means carried by the carrier, to project toward the surface for scrubbing that surface, b) first means for attaching an elongated handle to the carrier to extend in a first direction from the carrier, c) and manually manipulable structure for adjustably attaching a mop to the carrier with mop strands extending in generally parallel relation with that surface and in mopping contact therewith as the scrubbing means simultaneously engages that surface, for simultaneous mopping and scrubbing of that surface, as the handle extends at an angle to the surface to displace the carrier, scrubbing means and mop parallel to the floor surface, d) said mop having a head adjustably attached to the carrier at a first side of the carrier.

2. The combination of claim 1 wherein said structure includes a clamp for clamping the mop head to the carrier.

3. The combination of claim 1 including said handle attached to the carrier at a second side of the carrier spaced from said mop head.

4. The combination of claim 3 wherein said carrier second side faces relatively upwardly, and said carrier first side faces relatively forwardly.

5. The combination of claim 3 including an upward protrusion on said second side of the carrier, the handle attached to said protrusion.

6. The combination of claim 3 including an upward protrusion on said second side of the carrier, the handle attached to said protrusion.

7. The combination of claim 1 wherein said structure carries the mop in adjustably spaced relation to the carrier.

8. The combination of claim 7 including said handle attached to the carrier at a second side thereof spaced from said mop head, said mop head extends in a lateral direction, and said head is adjustably movable in a longitudinal direction, whereby a plane extending in said longitudinal direction and passing through said handle also bisects said carrier.

9. The combination of claim 8 wherein said carrier has first and second parts which are relatively movable longitudinally, the scrubbing means carried by at least one of said parts, said parts relatively adjustably movable longitudinally to clamp the mop head.

10. The combination of claim 9 wherein the second part has attachment to the first part at substantially laterally spaced locations.

11. The combination of claim 10 including fasteners at said laterally spaced locations, said fasteners adjustable to allow said relative longitudinal movement of said parts.

12. The combination of claim 9 wherein said first and second parts have pivoted attachment at one of said locations, whereby the second part is swingable toward and away from the first part.

13. The combination of claim 12 wherein the first and second parts have longitudinally adjustable attachment at the other of said locations.

14. The combination of claim 13 wherein said longitudinally adjustable attachment includes a ratchet connection between said parts.

15. The combination of claim 1 wherein said structure includes a bail carried by the carrier to adjustably swing into mop head clamping position.

16. The combination of claim 15 wherein said structure includes a bar adjustably movable relative to the bail to clamp the mop head between the bar and bail, there being an adjustable connection between the bar and carrier to adjustably move the bar relative to the bail.

17. The combination of claim 1 wherein said structure includes an adjustable clamp for adjustably clamping the mop head, and having first position in which the mop head is removable from attachment to the carrier, and a second position in which the mop head is attached to the carrier.

18. The combination of claim 17 wherein said structure includes a lever having a rotated position in which said mop head is clamped.

19. The combination of claim 17 wherein said clamp has a part with adjustable screw thread fastener attachment to the carrier.

20. The combination of claim 19 wherein said attachment includes a rotor presented at a side of the carrier for manual manipulation to adjust said screw thread attachment.

21. The combination of claim 1 wherein said scrubbing means comprises at least one of the following:

i) bristles ii) pad.

22. The combination of claim 21 wherein said bristles include rows of bristles, the bristles of at least one bristle row having length greater than bristles in other rows, said one row extending parallel to said mop head.

23. Apparatus for scrubbing and mopping a surface, comprising in combination:

a) a supporting carrier, including a block and scrubbing means carried by the carrier, to project toward the surface for scrubbing that surface, b) first means for attaching an elongated handle to the carrier to extend in a first direction from the carrier, c) and manually manipulable structure for adjustably attaching a mop to the carrier with mop strands extending in generally parallel relation with that surface and in mopping contact therewith as the scrubbing means simultaneously engages that surface, for simultaneous mopping and scrubbing of that surface, as the handle extends at an angle to the surface to displace the carrier, scrubbing means and mop parallel to the floor surface, d) said structure including a bail carried by the carrier to adjustably swing into mop head clamping position.

24. The combination of claim 23 including said handle attached to the carrier at a second side of the carrier spaced from said mop head.

25. The combination of claim 24 wherein said carrier second side faces relatively upwardly, and said carrier first side faces relatively forwardly.

26. The combination of claim 23 wherein said structure carries the mop in adjustably spaced relation to the carrier.

27. The combination of claim 26 including said handle attached to the carrier at a second side thereof spaced from said mop head, said mop head extends in a lateral direction, and said head is adjustably movable in a longitudinal direction, whereby a plane extending in said longitudinal direction and passing through said handle also bisects said carrier.

28. The combination of claim 27 wherein said carrier has first and second parts which are relatively movable longitudinally, the scrubbing means carried by at least one of said parts, said parts relatively adjustably movable longitudinally to clamp the mop head.

29. The combination of claim 23 wherein said structure includes a bar adjustably movable relative to the bail to clamp the mop head between the bar and bail, there being an adjustable connection between the bar and carrier to adjustably move the bar relative to the bail.

30. The combination of claim 23 wherein said scrubbing means comprises at least one of the following:

i) bristles ii) pad.

31. The combination of claim 30 wherein said bristles include rows of bristles, the bristles of at least one bristle row having length greater than bristles in other rows, said one row extending parallel to said mop head.

* * * * *